US006098219A

United States Patent [19]

Milber

[11] Patent Number: 6,098,219

[45] Date of Patent: Aug. 8, 2000

[54] BED SHEET ATTACHMENT SYSTEM

[76] Inventor: Diane Milber, 650 Kirkham St., San Francisco, Calif. 94122

[21] Appl. No.: 09/054,586

[22] Filed: Apr. 3, 1998

[51] Int. Cl.[7] ..... A47G 9/04

[52] U.S. Cl. ..... 5/494; 5/498; 5/502

[58] Field of Search ..... 5/494, 496, 498, 5/500, 502

[56] References Cited

U.S. PATENT DOCUMENTS

| | | | |
|---|---|---|---|
| 3,083,378 | 4/1963 | Pursell | 5/498 |
| 3,530,487 | 9/1970 | Beer | 5/500 X |
| 3,857,124 | 12/1974 | Hadley | 5/494 |
| 3,879,777 | 4/1975 | Walker | 5/500 |
| 5,042,099 | 8/1991 | Brenner et al. | 5/498 X |
| 5,208,926 | 5/1993 | Stackhouse | 5/496 X |
| 5,666,680 | 9/1997 | Hackett, Jr. | 5/496 |

*Primary Examiner*—Michael F. Trettel

[57] ABSTRACT

A new bed sheet attachment system for facilitating bed making. The inventive device includes a plurality of sheet members including a bottom sheet member, a top sheet member, and a first middle sheet member. Each sheet member has upper and lower surfaces, opposite head and foot ends and a pair of sides extending between the head and foot ends. The bottom sheet member is adapted for covering a mattress while the lower surface of the top sheet member is designed for resting on the upper surface of another sheet member. The first middle sheet member is designed for interposing between the top sheet member and the bottom sheet member. The upper surface of the bottom sheet member is attachable by zippers to the lower surface of another sheet member. The lower surface of the top sheet member is attachable to the upper surface of another sheet member by zippers. The upper surface of the first middle sheet member is attachable by zippers to the lower surface of another sheet member and the lower surface of the first middle sheet member is attachable by zippers to the upper surface of another sheet member.

1 Claim, 3 Drawing Sheets

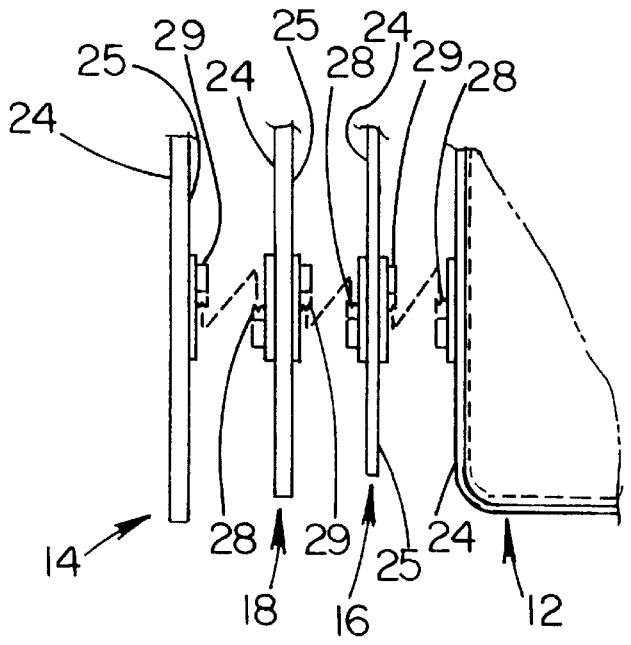
FIG. 2
FIG. 3
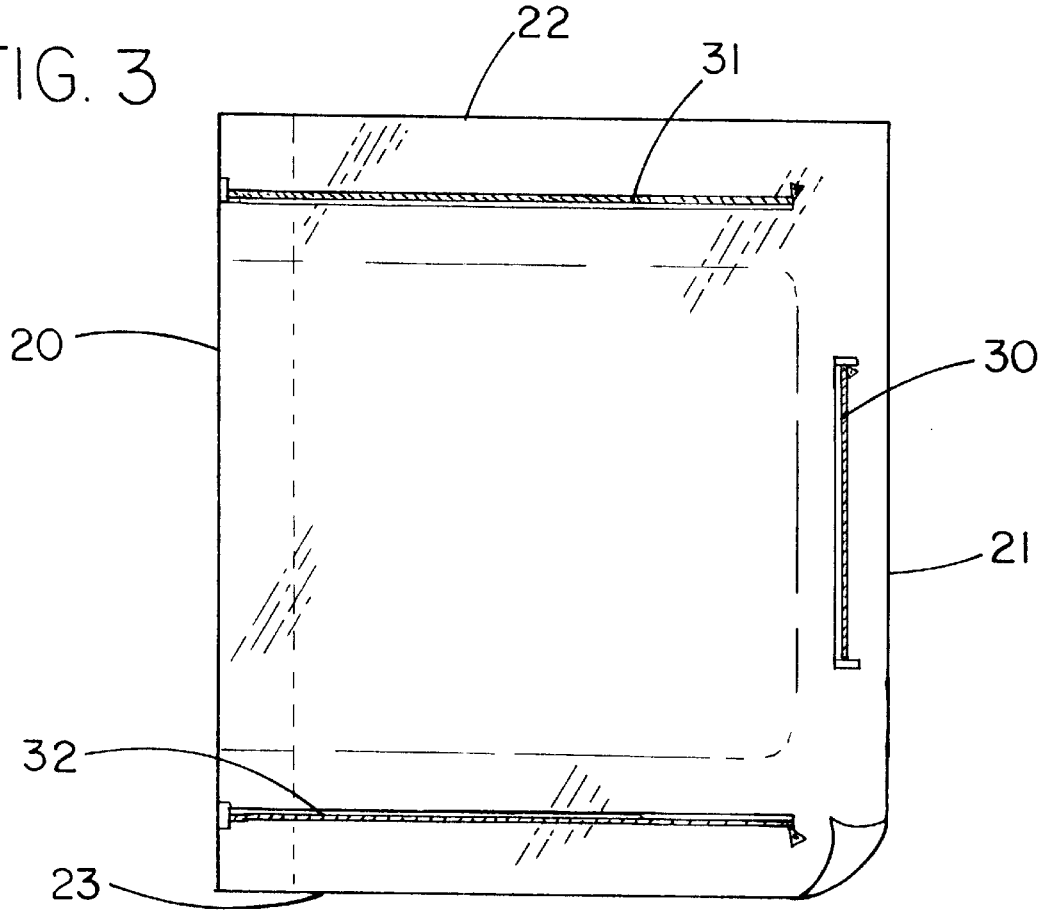

BED SHEET ATTACHMENT SYSTEM

BACKGROUND OF THE INVENTION

1. Field of the Invention

The present invention relates to bed sheets and more particularly pertains to a new bed sheet attachment system for facilitating bed making.

2. Description of the Prior Art

The use of bed sheets is known in the prior art. More specifically, bed sheets heretofore devised and utilized are known to consist basically of familiar, expected and obvious structural configurations, notwithstanding the myriad of designs encompassed by the crowded prior art which have been developed for the fulfillment of countless objectives and requirements.

Known prior art bed sheets include U.S. Pat. No. 5,208,927; U.S. Pat. No. 4,658,454; U.S. Pat. No. 5,335,383; U.S. Pat. No. 5,177,821; U.S. Pat. No. 4,615,061; and U.S. Pat. No. Des. 313,140.

While these devices fulfill their respective, particular objectives and requirements, the aforementioned patents do not disclose a new bed sheet attachment system. The inventive device includes a plurality of sheet members including a bottom sheet member, a top sheet member, and a first middle sheet member. Each sheet member has upper and lower surfaces, opposite head and foot ends and a pair of sides extending between the head and foot ends. The bottom sheet member is adapted for covering a mattress while the lower surface of the top sheet member is designed for resting on the upper surface of another sheet member. The first middle sheet member is designed for interposing between the top sheet member and the bottom sheet member. The upper surface of the bottom sheet member is attachable by zippers to the lower surface of another sheet member. The lower surface of the top sheet member is attachable to the upper surface of another sheet member by zippers. The upper surface of the first middle sheet member is attachable by zippers to the lower surface of another sheet member and the lower surface of the first middle sheet member is attachable by zippers to the upper surface of another sheet member.

In these respects, the bed sheet attachment system according to the present invention substantially departs from the conventional concepts and designs of the prior art, and in so doing provides an apparatus primarily developed for the purpose of facilitating bed making.

SUMMARY OF THE INVENTION

In view of the foregoing disadvantages inherent in the known types of bed sheets now present in the prior art, the present invention provides a new bed sheet attachment system construction wherein the same can be utilized for facilitating bed making.

The general purpose of the present invention, which will be described subsequently in greater detail, is to provide a new bed sheet attachment system apparatus and method which has many of the advantages of the bed sheets mentioned heretofore and many novel features that result in a new bed sheet attachment system which is not anticipated, rendered obvious, suggested, or even implied by any of the prior art bed sheets, either alone or in any combination thereof.

To attain this, the present invention generally comprises a plurality of sheet members including a bottom sheet member, a top sheet member, and a first middle sheet member. Each sheet member has upper and lower surfaces, opposite head and foot ends and a pair of sides extending between the head and foot ends. The bottom sheet member is adapted for covering a mattress while the lower surface of the top sheet member is designed for resting on the upper surface of another sheet member. The first middle sheet member is designed for interposing between the top sheet member and the bottom sheet member. The upper surface of the bottom sheet member is attachable by zippers to the lower surface of another sheet member. The lower surface of the top sheet member is attachable to the upper surface of another sheet member by zippers. The upper surface of the first middle sheet member is attachable by zippers to the lower surface of another sheet member and the lower surface of the first middle sheet member is attachable by zippers to the upper surface of another sheet member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bed sheet attachment system apparatus and method which has many of the advantages of the bed sheets mentioned heretofore and many novel features that result in a new bed sheet attachment system which is not anticipated, rendered obvious, suggested, or even implied by any of the prior art bed sheets, either alone or in any combination thereof.

It is another object of the present invention to provide a new bed sheet attachment system which may be easily and efficiently manufactured and marketed.

It is a further object of the present invention to provide a new bed sheet attachment system which is of a durable and reliable construction.

An even further object of the present invention is to provide a new bed sheet attachment system which is susceptible of a low cost of manufacture with regard to both materials and labor, and which accordingly is then susceptible of low prices of sale to the consuming public, thereby making such bed sheet attachment system economically available to the buying public.

Still yet another object of the present invention is to provide a new bed sheet attachment system which provides in the apparatuses and methods of the prior art some of the advantages thereof, while simultaneously overcoming some of the disadvantages normally associated therewith.

Still another object of the present invention is to provide a new bed sheet attachment system for facilitating bed making.

Yet another object of the present invention is to provide a new bed sheet attachment system which includes a plurality of sheet members including a bottom sheet member, a top sheet member, and a first middle sheet member. Each sheet member has upper and lower surfaces, opposite head and foot ends and a pair of sides extending between the head and foot ends. The bottom sheet member is adapted for covering a mattress while the lower surface of the top sheet member is designed for resting on the upper surface of another sheet member. The first middle sheet member is designed for interposing between the top sheet member and the bottom sheet member. The upper surface of the bottom sheet member is attachable by zippers to the lower surface of another sheet member. The lower surface of the top sheet member is attachable to the upper surface of another sheet member by zippers. The upper surface of the first middle sheet member is attachable by zippers to the lower surface of another sheet member and the lower surface of the first middle sheet member is attachable by zippers to the upper surface of another sheet member.

Still yet another object of the present invention is to provide a new bed sheet attachment system that allows the easy making of a neat bed by using zippers along the perimeter of the sheets to attach adjacent sheets to one another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic partial side view of the present invention showing the relationship between the sheet members for attachment.

FIG. 3 is a schematic bottom view of a sheet member.

DESCRIPTION OF THE PREFERRED EMBODIMENT

Figure 1:
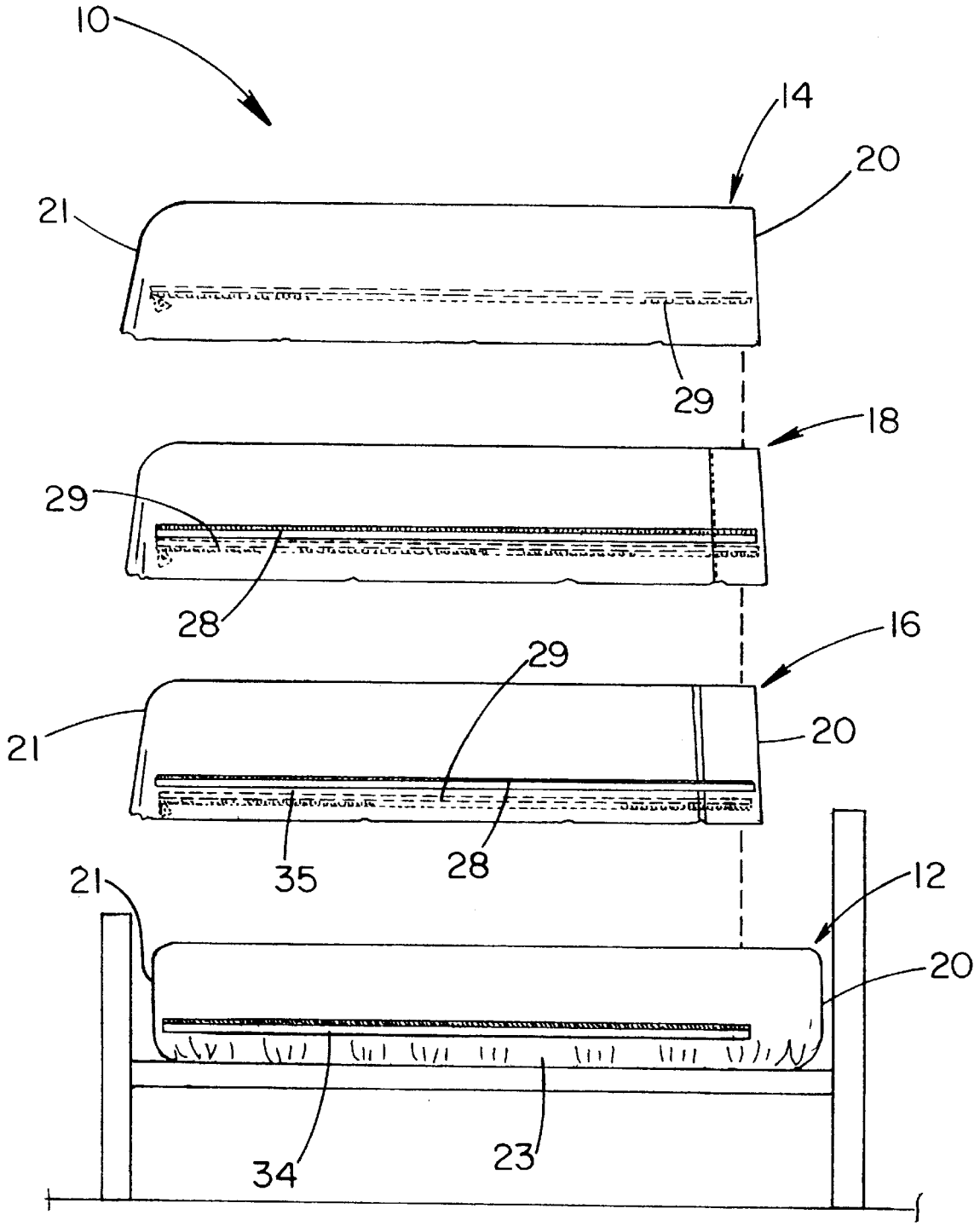
FIG. 1 is a schematic exploded side view of a new bed sheet attachment system according to the present invention.

With reference now to the drawings, and in particular to FIGS. 1 through 4 thereof, a new bed sheet attachment system embodying the principles and concepts of the present invention and generally designated by the reference numeral 10 will be described.

As best illustrated in FIGS. 1 through 4, the bed sheet attachment system 10 generally comprises a plurality of sheet members including a bottom sheet member 12, a top sheet member 14, and a first middle sheet member 16. Each sheet member 12,14,16 has upper and lower surfaces 24,25, opposite head and foot ends 20,21 and a pair of sides 22,23 extending between the head and foot ends 20,21. The bottom sheet member 12 is adapted for covering a mattress while the lower surface of the top sheet member 14 is designed for resting on the upper surface of another sheet member. The first middle sheet member 16 is designed for interposing between the top sheet member 14 and the bottom sheet member 12. The upper surface of the bottom sheet member 12 is attachable by zippers to the lower surface of another sheet member. The lower surface of the top sheet member 14 is attachable to the upper surface of another sheet member by zippers. The upper surface of the first middle sheet member 16 is attachable by zippers to the lower surface of another sheet member and the lower surface of the first middle sheet member 16 is attachable by zippers to the upper surface of another sheet member.

Figure 4:
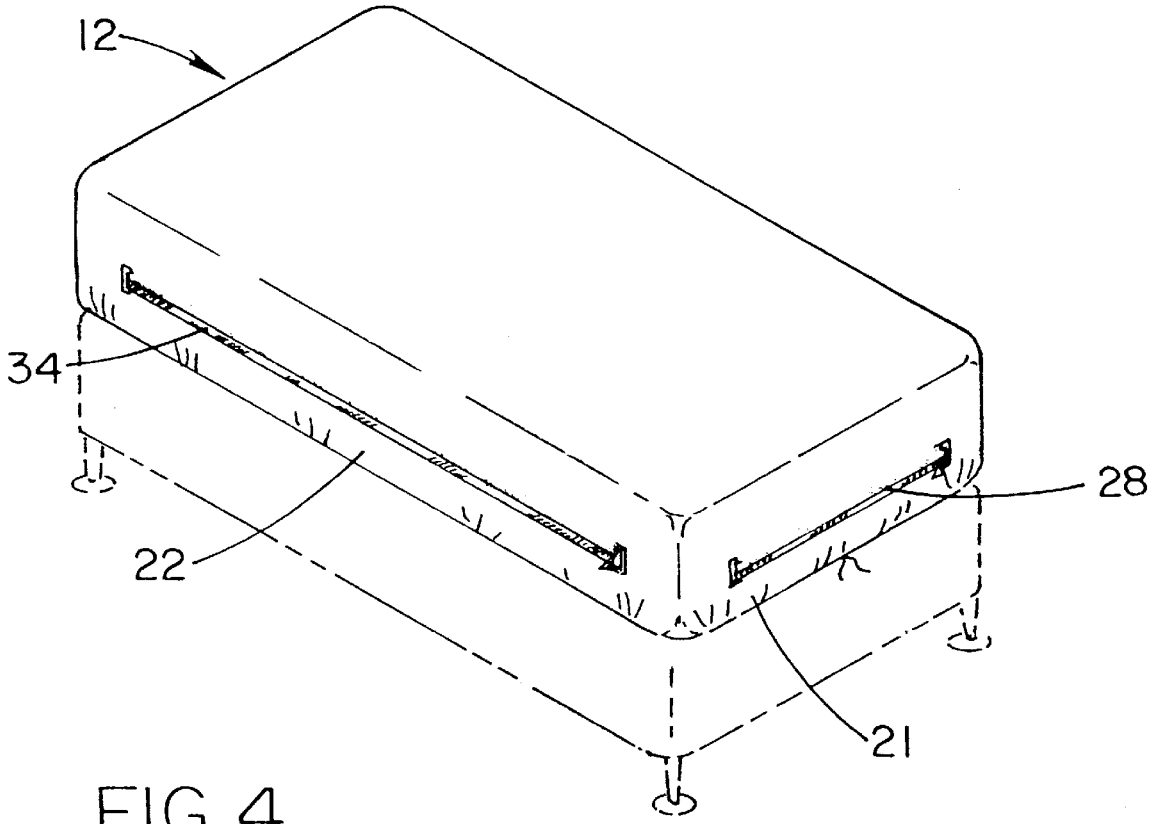
FIG. 4 is a schematic perspective view of the bottom sheet member.

In closer detail, as best illustrated in FIGS. 2 and 3, each sheet member 12,14,16,18 has upper and lower surfaces 24,25, opposite head and foot ends 20,21 and a pair of sides 22,23 extending between the head and foot ends 20,21. The sheet members include a bottom sheet member 12, a top sheet member 14, a first middle sheet member 16, and preferably a second middle sheet member 18. As illustrated in FIGS. 1 and 4, the bottom sheet member 12 is adapted for covering a mattress and is preferably a fitted sheet. The top sheet member 14 and the first and second middle sheet members 16,18 are preferably generally rectangular as shown in FIG. 3. The lower surface 24 of the top sheet member 14 is designed for resting on the upper surface of another sheet member and is preferably a comforter, a quilt or a bed spread. The first and second middle sheet members 16,18 are designed for interposing between the top sheet member 14 and the bottom sheet member 12. The first middle sheet member 16 is preferably a bed sheet while the second middle sheet member 18 is preferably a blanket.

The system 10 attaches adjacent sheet members by using a number of complementary elongate first and second zipper portions 28,29. Each first zipper portion 28 is detachably attachable to an associated second zipper portion 29. Alternately, other fasteners such as lengths of hook and loop fasteners may be used instead of zippers. The upper surfaces 24 of the bottom, first middle, and second middle sheet members 12,16,18 each have a set of first zipper portions provided thereon. FIG. 3 illustrates the preferred location of zipper portions on a sheet member. One first zipper portion 30 of each set of first zipper portions is located adjacent the foot end 21 of its associated sheet member. Another first zipper portion 31 of the set of first zipper portions is located adjacent one of the sides 22 of the associated sheet member, while a third first zipper portion 32 of the set of first zipper portions is located adjacent the other of the sides 23 of the associated sheet member. In the preferred embodiment, the length of the one first zipper portion 30 extends substantially parallel with the foot end 21 of its associated sheet member while the lengths of the another and third first zipper portions 31,32 extend substantially parallel with their respective sides of the associated sheet member.

In a similar arrangement as the upper surfaces, the lower surfaces of the top, first middle, and second middle sheet members 14,16,18 each have a set of second zipper portions 29 provided thereon. The second zipper portions are arranged so that they are attachable to associated first zipper portions of another sheet with one second zipper portion located adjacent the foot end 21, another second zipper portion located adjacent one of the sides of the associated sheet member, and a third second zipper portion located adjacent the other of the sides of the associated sheet member. Like the first zipper portions, preferably, the length of the second zipper portion are substantially parallel with their associated end or side. FIG. 2, illustrates the attachment of zipper portions to one another with the first zipper portions of one of the sheet members detachably attachable to the associated second zipper portions of the lower surface of an adjacent sheet member. Ideally, as illustrated in FIG. 1, the zipper portions 34 of the bottom sheet member 12 do not extend all the way to the head end 20 of the bottom sheet member 12 unlike the zipper portion 35 of the other sheet members so that head ends 20 of the other sheet members 14,16,18 are spaced apart from the head end 20 of the bottom sheet member 12.

In use, the bottom sheet member 12 is first mounted to a mattress to cover the mattress with the upper surface 24 of the bottom sheet member facing outwards. The first middle sheet member 16 is then rested on the bottom sheet member 12 with the lower surface 25 of the first middle sheet member facing the upper surface 24 of the bottom sheet member 12 and with the second zipper portions 29 of the first middle sheet member aligned with the first zipper portions 28 of the bottom sheet member 12. The first middle sheet member 16 is then attached to the bottom sheet member 12 by the fastening of the first zipper portions to their associated second zipper portion. The second middle sheet member 18 is placed over the first middle sheet member attached to the first middle sheet member 16 in a similar fashion with the corresponding zipper portions. Alternately, the order of the first and second middle sheet members may be reversed and a user may add additional first and second middle sheet members as needed. The lower surface of top sheet member is then attached to the upper surface of the top most middle sheet member with their respective zipper portions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed sheet attachment system, comprising:

a plurality of sheet members, each sheet member having upper and lower surfaces, opposite head and foot ends and a pair of sides extending between said head and foot ends;

said sheet members including a bottom sheet member, a top sheet member, a first middle sheet member, and a second middle sheet member;

said bottom sheet member being adapted for covering a mattress, wherein said bottom sheet member is a fitted sheet;

said top sheet member being generally rectangular, said lower surface of said top sheet member being for resting on the upper surface of another sheet member, wherein said top sheet member is a comforter;

said first middle sheet member being generally rectangular, wherein said first middle sheet is a bed sheet;

said a second middle sheet member being generally rectangular, wherein said second middle sheet member is a blanket, said first and second middle sheet members being for interposing between said top sheet member and said bottom sheet member;

wherein said upper surface of said bottom sheet member is attachable to said lower surface of another sheet member;

wherein said lower surface of said top sheet member is attachable to said lower surface of another sheet member;

wherein said upper surface of said first middle sheet member is attachable to said lower surface of another sheet member and wherein said lower surface of said first middle sheet member is attachable to said upper surface of another sheet member;

wherein said upper surface of said second middle sheet member is attachable to said lower surface of another sheet member, and wherein said lower surface of said second middle sheet member is attachable to said upper surface of another sheet member;

a number of complementary elongate continuous first and second zipper portions, each first zipper portion being detachably attachable to a second zipper portion, each first and second zipper portion having a length;

the upper surfaces of said bottom, first middle, and second middle sheet members each having a set of first zipper portions provided thereon, one first zipper portion of said set of first zipper portions being located adjacent to and spaced from said foot end of the associated sheet member and extending along a central extent of said foot end, another first zipper portion of said set of first zipper portions being located adjacent to and spaced from one of said sides of the associated sheet member, a third first zipper portion of said set of first zipper portions being located adjacent to and spaced from the other of said sides of the associated sheet member, wherein the length of said one first zipper portion of each set of first zipper portions is extended substantially parallel with the foot end of the associated sheet member, wherein the lengths of said another and third first zipper portions of each set of first zipper portions are extended substantially parallel with the sides of the associated sheet member;

wherein each of said first zipper portions that is located adjacent to said foot end has a pair of terminal ends spaced from ends of said first zipper portions that are located adjacent to said sides of said sheet member;

the lower surfaces of said top, first middle, and second middle sheet members each having a set of second zipper portions provided thereon, one second zipper portion of said set of second zipper portions being located adjacent to and spaced from said foot end of the associated sheet member, another second zipper portion of said set of second zipper portions being located adjacent to and spaced from one of said sides of the associated sheet member, a third second zipper portion of said set of second zipper portions being located adjacent to and spaced from the other of said sides of the associated sheet member, wherein the length of said one second zipper portion of each set of second zipper portions is extended substantially parallel with the foot end of the associated sheet member, wherein the lengths of said another and third second zipper portions of each set of second zipper portions are extended substantially parallel with the sides of the associated sheet member;

wherein said zipper portion of said bottom sheet member is spaced from said head end of said bottom sheet member so that head ends of said first middle, second middle, and top sheet members may be spaced apart from said head end of said bottom sheet member;

wherein said zipper portions of said top, first middle, and second middle sheet members extend to said heads of said top, first middle, and second middle sheet members, wherein said zipper portions of said top, first middle, and second middle sheet members have lengths substantially equal to that of the associated sheet member;

wherein said bottom sheet member is removably positioned on a mattress to define a top face, a bottom face, and a peripheral side wall defined by four vertically oriented side wall portions, wherein the first zipper portions of said upper surface of said bottom sheet member are positioned on said upper surface of said bottom sheet member such that the same reside along lower edges of said side walls and adjacent to said bottom face;

wherein a distance between said first zipper portions and said sides and said foot ends of each of said sheet members is unique in order to afford staggered overlapping of said sheet members;

wherein said first zipper portions of said set of first zipper portions of said upper surface of said first middle and second middle sheet member are positioned spaced above from and parallel with said second zipper portions of said set of first zipper portions of said lower surface of said first middle and second middle sheet member, respectively; and wherein the first zipper portions of the set of first zipper portions of the upper surface of one of said sheet members are detachably attachable to the associated second zipper portions of the set of second zipper portions of the lower surface of an adjacent sheet member.

* * * * *